US005302047A

United States Patent [19]

Ivey

[11] Patent Number: 5,302,047

[45] Date of Patent: * Apr. 12, 1994

[54] PEDESTRIAN SAFETY BARRIER

[75] Inventor: Don L. Ivey, Bryan, Tex.

[73] Assignee: Texas A&M University System, College Station, Tex.

[ * ] Notice: The portion of the term of this patent subsequent to Oct. 20, 2009 has been disclaimed.

[21] Appl. No.: 907,153

[22] Filed: Jul. 1, 1992

Related U.S. Application Data

[63] Continuation-in-part of Ser. No. 691,392, Apr. 25, 1991, Pat. No. 5,156,485.

[51] Int. Cl.[5] ..... E01F 13/00; E01F 15/00

[52] U.S. Cl. ..... 404/6; 256/13.1

[58] Field of Search ..... 404/6, 7; 256/1, 13.1

[56] References Cited

U.S. PATENT DOCUMENTS

| | | | |
|---|---|---|---|
| 1,067,501 | 7/1913 | Brown | 404/7 |
| 3,037,433 | 6/1962 | Maher | 404/7 |
| 3,636,829 | 1/1972 | Palmer | 404/7 |
| 3,643,924 | 2/1972 | Fitch | 256/13.1 |
| 3,674,115 | 7/1972 | Young et al. | 188/1 B |
| 3,845,936 | 11/1974 | Boedecker, Jr. | 256/1 |
| 3,944,187 | 3/1976 | Walker | 256/13.1 |
| 3,982,734 | 9/1976 | Walker | 256/13.1 |
| 4,066,244 | 1/1978 | Yoho | 256/1 |
| 4,113,400 | 9/1978 | Smith | 404/6 |
| 4,198,036 | 4/1980 | O'Neal | 267/140 |
| 4,307,973 | 12/1981 | Glaesener | 404/6 |
| 4,348,133 | 9/1982 | Trent et al. | 404/6 |
| 4,407,484 | 10/1983 | Meinzer | 256/13.1 |
| 4,502,812 | 3/1985 | Zucker | 404/6 |
| 4,605,336 | 8/1986 | Slaw, Sr. | 404/6 |
| 4,661,010 | 4/1987 | Almer et al. | 404/6 |
| 4,815,565 | 3/1989 | Sicking et al. | 188/32 |
| 4,822,208 | 4/1989 | Ivey | 404/6 |
| 4,971,475 | 11/1990 | Castonguay et al. | 404/7 |
| 5,007,763 | 4/1991 | Burgett | 404/6 |

OTHER PUBLICATIONS

Ivey, et al., Portable Concrete Median Barrier: Structural Design and Dynamic Performance, Transportation Research Record No. 769, (1980) at pp. 20–30.

Bronstad and Kimball, Temporary Barriers used in Construction Zones, (Dec. 1977), (D.O.T. No.: DOT-FH-11-8130).

*Primary Examiner*—William P. Neuder

*Attorney, Agent, or Firm*—Arnold, White & Durkee

[57] ABSTRACT

An elongated pedestrian safety barrier adapted to be longitudinally disposed between a roadway and an adjoining pedestrian walkway. The safety barrier features a concrete structure up to about 24 inches in height having an outwardly angled sidewall facing the roadway and a concavity on its bottom surface to engage the top and roadside surface of a standard curb.

11 Claims, 2 Drawing Sheets

PEDESTRIAN SAFETY BARRIER

This application is a continuation-in-part of patent application No. 07/691,392 filed Apr. 25, 1991, which is incorporated herein by reference.

BACKGROUND OF THE INVENTION

1. Field of the Invention

The present invention generally relates to a new and improved raised pedestrian safety barrier adapted to supplement an existing curb structure between a roadway and an adjoining pedestrian walkway. The safety barrier features a low profile and an outer sidewall facing toward the road which angles outwardly from the barrier base so as to reduce ramp and roll tendencies of vehicles impacting on the barrier.

2. Description of the Prior Art

It is standard practice today to provide a curb structure alongside a roadway to facilitate drainage and provide a roadway limitation so that traffic is encouraged to remain within the roadway limits. Modern curbs are normally about 6" in height and present either a rounded or roughly rectangular shape to provide a modest step-like structure which allows pedestrians to easily step down into the roadway and cross at a crosswalk or perform a similar operation.

Unfortunately, modern curbs afford little actual protection to pedestrians in a walkway adjoining a roadway. This fact is particularly emphasized in urban areas when construction occurs in the roadway area. Often, barriers are erected between the pedestrian and roadway areas in the form of plywood structures which house the walkways.

However, these structures also provide little actual protection from roadway traffic.

Accordingly, a need persists for a more substantial pedestrian safety barrier which can reduce the risks of adjoining roadway traffic.

SUMMARY OF THE INVENTION

The present invention, in a broad aspect, comprises an elongated, concrete pedestrian safety barrier. The pedestrian safety barrier lies substantially parallel to the direction of traffic movement and is comprised of one or more segments of structural reinforced concrete which (1) measure from about 10 to about 24 inches (and is preferably about 14") in height above a roadway, and (2) have an outer sidewall facing the roadway which angles outwardly from the barrier base. The barrier further features a concavity by which it is adapted to be installed on the top and roadside surface of a curb. The barrier in any given installation will normally span the top surface of the curb, and extend down proximate the surface of the roadway.

The concrete barrier segments may be affixed to a curb for permanent use along a finished road. Barriers may also be cast in place in some instances, such as in bridge construction.

Advantages emanate from the outward angling from the barrier base of the sidewall facing a road traffic lane. The upwardly outward angle of the sidewall helps to make vehicle collisions safer by reducing deflection of the barrier and consequently the rolling and ramping of impacting vehicles. In one preferred embodiment, a pedestrian safety barrier is comprised of a plurality of individual barrier segments placed end to end. The top roadside corners of the barrier segments are preferably chamfered or otherwise rounded.

As stated earlier, the control of large trucks and trailers, such as in construction zones, presents an especially difficult problem for conventional curbs and barriers In that regard, it is contemplated that the barriers of the invention with their greater mass and unique sidewall angles will prove considerably more effective than current conventional means in dealing with this problem. Thus, it is expected that even large trucks and tractor-trailers will be able to impact the new barriers at higher angles without smashing through or climbing the barriers.

DETAILED DESCRIPTION OF THE INVENTION

A preferred embodiment of the present invention is depicted by FIGS. 1–4. Pedestrian safety barrier segments 10 are comprised of concrete structures reinforced by exemplary steel reinforcing bars 14.

Figure 2:
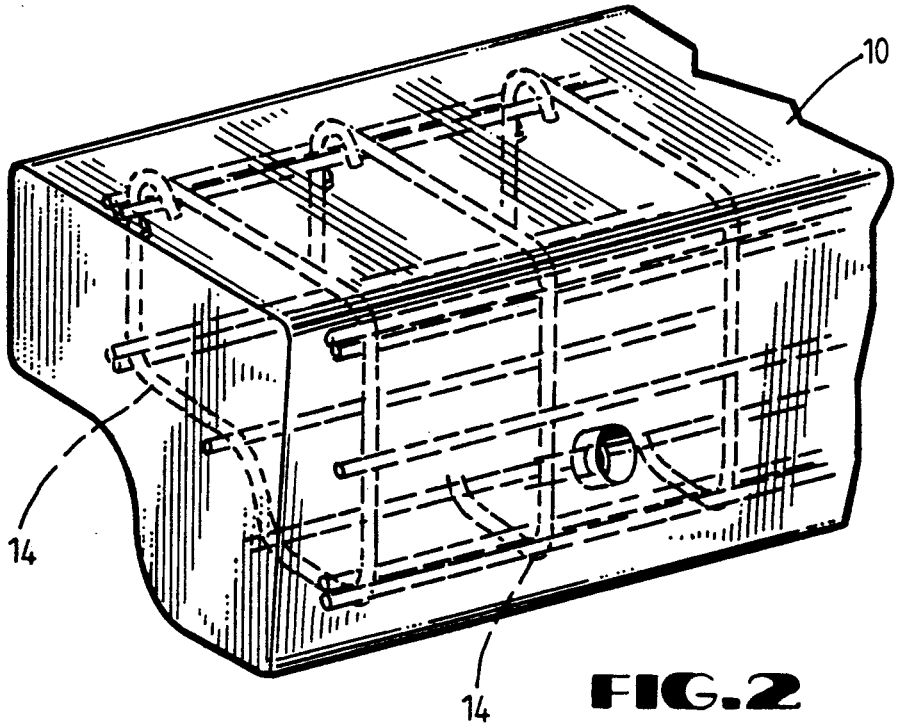
FIGS. 2–3 show exemplary methods for reinforcement of pedestrian safety barrier segments.
Figure 3:
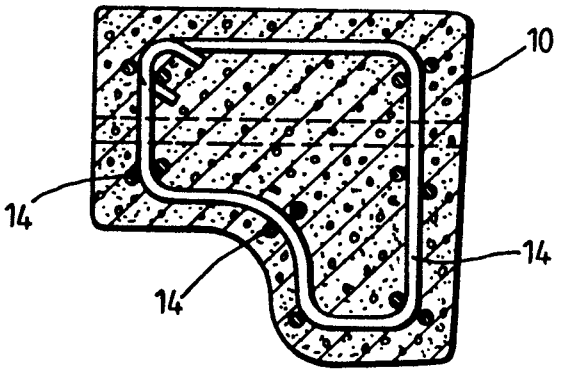

FIGS. 2–3 depict exemplary configurations that reinforcing steel bars 14 in the barrier segment 10 may take. Steel reinforcement is preferred throughout the barrier segment.

In urban type construction zones, the safety barrier segments are typically temporarily emplaced along curbs. In this mode, the segments may be relocated and are often preformed to include apertures along the base of barrier segment 10, as shown in FIG. 2, to permit forklift tines or similar lifting apparatus to move each segment.

Figure 1:
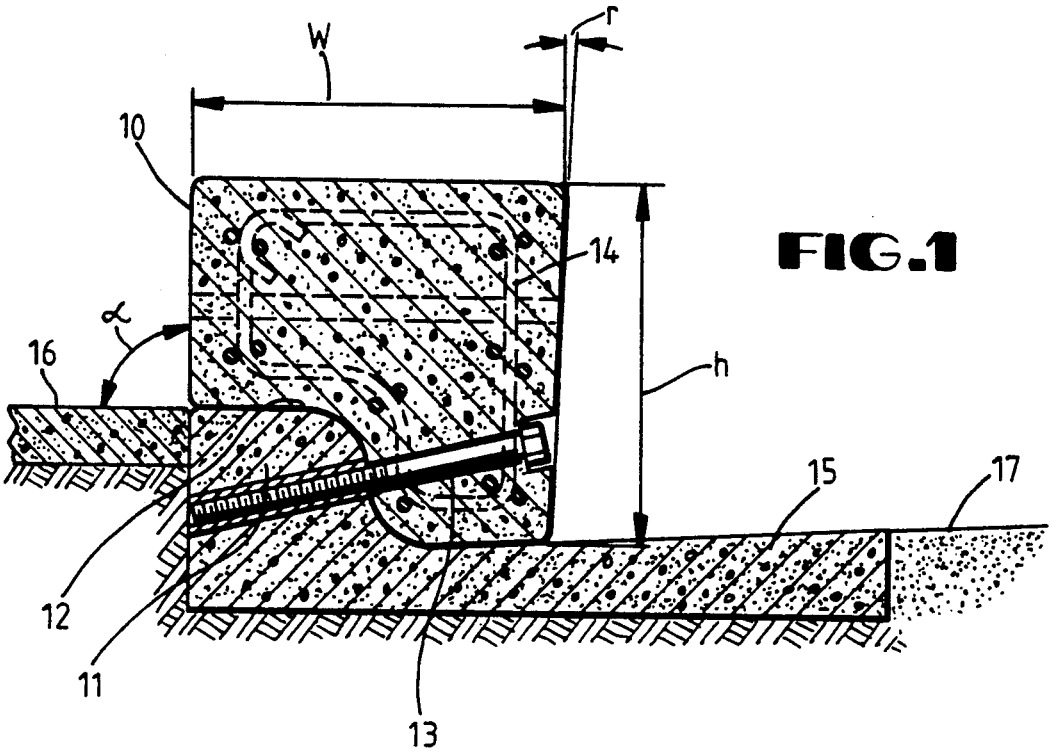
FIG. 1 shows a transverse cross-section of an embodiment of the invention in which a pedestrian safety barrier is disposed between a traffic lane and an adjoining pedestrian walkway.

As may be seen in FIG. 1, the barrier segments may be affixed to curb 11 by dowels, bolts or other methods in such a way that the barrier is prevented from deflecting significantly.

Alternatively, a barrier may be constructed by casting larger sections in place along the designated roadway. This system of construction is particularly appropriate in bridge construction wherein the bridge's surface includes a roadway and adjoining walkway. Casting may be accomplished using slip forms or conventional wooden forms. As with the preformed segments described above, these larger segments may either be affixed to the surface by dowels, bolts, and so on, or merely rest on the surface. Additionally, through tie-ins of reinforcing steel, or use of a preformed groove or keyway the cast-in-place sections may be made permanently attached to the surface.

As shown especially in FIG. 1, the barrier's roadside sidewall is angled outwardly from the barrier base. Such an angle r acts to direct the primary thrust of a barrier on a colliding vehicle wheel preferably at or above the center of the wheel hub. In this regard, the wheel diameters of vehicles currently range from about 22 inches for compact automobiles to about 42 inches for large trucks. Thus, a 22-inch tall barrier of the invention will normally be capable of engaging almost all vehicle wheels above the center of the wheels. It is contemplated, however, that those barriers will function at heights as low as ten inches, even though this height is below the hub center of some autos and large trucks. Speeds of vehicles on roads alongside walkways will normally be much less than an open highways which are a principal concern in application Ser. No. 07/691,392.

The structural concrete used in the invention may typically have conventional compressive strengths of about 2,000 to 6,000 psi and more typically between about 3,000 and 5,000 psi after 28 days of curing. The concrete segments may also be advantageously formed of concrete, pre-stressed with steel cables in accordance with conventional methods.

As noted earlier, the height of the new pedestrian safety barrier as measured from the surface of the roadway, "h" in FIG. 1, may be from about 10 inches up to and including about 24 inches. For most installations involving vehicles traveling at moderate speeds (20 to 40 mph), barrier heights between about 12 and 24 inches will normally be preferred; and a barrier height of about 14 inches is particularly preferred for such installations.

Lengths suitable for concrete road barriers of the invention are widely variable, but the length of each barrier segment is preferably between about 5 and about 30 feet and most preferably between about 10 and 20 feet. The suitability of any given length will depend on several factors, including the geometry of the road, and contractor's preferences. The barrier width may also vary widely, depending in part on the width of the curb. The top width of the barrier, "w" in FIG. 1, may measure from about 8 inches to about 20 inches in width, and preferably about 14 inches wide. Although greater widths provide for a more substantial barrier, it should be recognized that increases in barrier widths result in reduced roadway width.

The outer sidewall of each concrete barrier facing the roadway should be disposed at an angle of between about 60 and about 89 degrees from the transverse axis of the barrier base. This angle is preferably between about 80 and about 88 degrees, and most preferably between about 87 and about 88 degrees. The steeper angles, among other factors, provide for greater mass.

The inner sidewall of each concrete barrier facing the pedestrian walkway 16 will preferably adjoin said walkway at an angle $\alpha$ of about 90°. Preferably also, the inner sidewall should be relatively flush with the rear surface of curb 11 which adjoins walkway 16.

Figure 4:
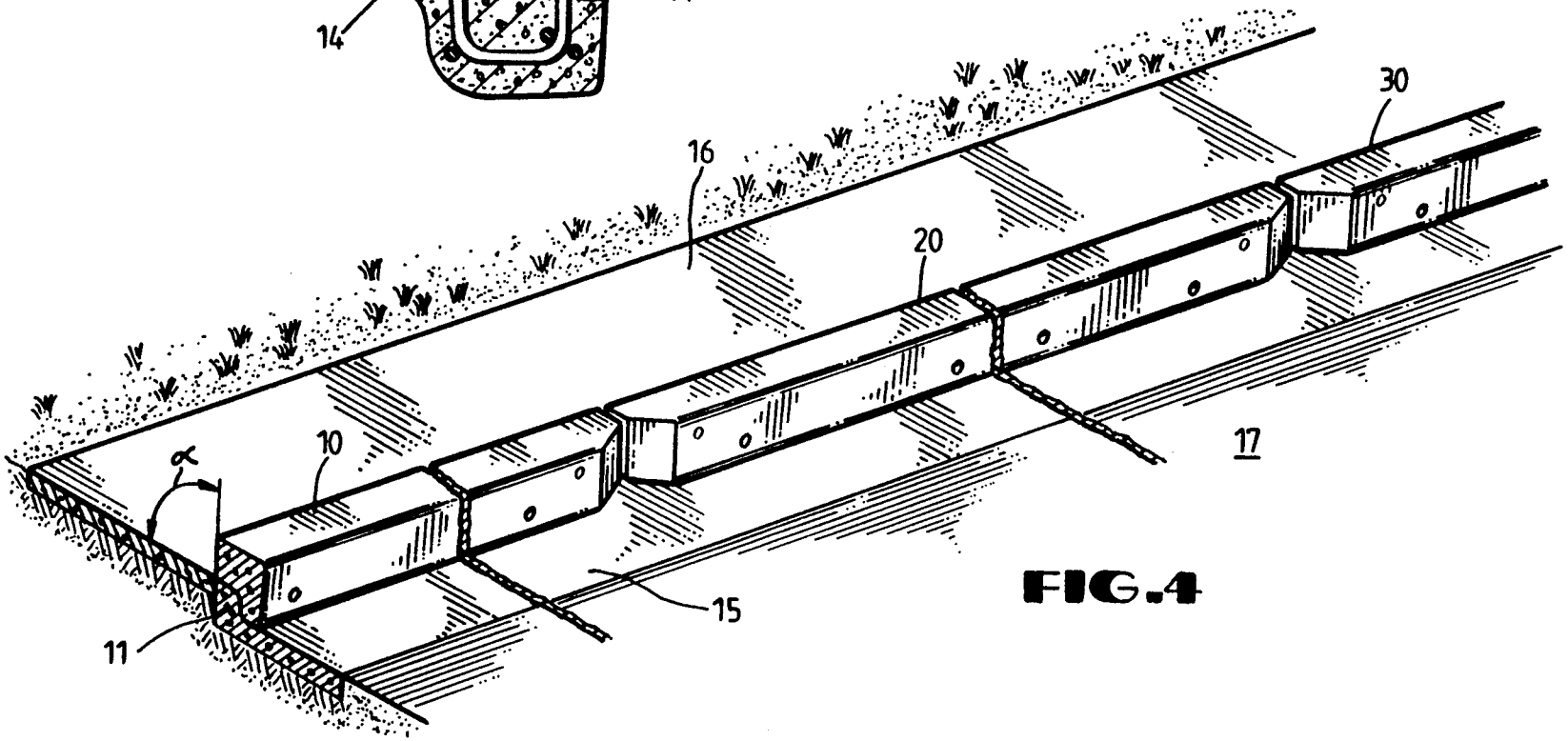
FIG. 4 is a perspective view showing a plurality of pedestrian safety barrier segments longitudinally disposed between a traffic lane and an adjoining pedestrian walkway.

As a result of unevenness or irregularities in the underlying curb structure, neighboring pedestrian safety barrier segments may not be properly aligned with each other when the segments are installed along a length of curb. It is, therefore, highly preferred that individual barrier segments be adapted with chamfered or otherwise rounded corners to reduce any hazard to vehicles associated with misaligned segments. An exemplary method of adapting these segments is illustrated in FIG. 4. Referring now to that figure, barrier segments 10, 20, 30 are shown disposed between roadway 17 and pedestrian walkway 16. Because the top roadside corners of the segments have been chamfered, a dangerous corner is not presented by a segment which is misaligned.

The invention's barrier provides additional safety in areas where construction work is under way in adjoining traffic lanes, and conventional curb heights may be inadequate to protect pedestrians from heavy rolling equipment.

FIG. 1 shows pedestrian safety barrier 10 adapted to engage a raised curb 11 by means of a cross-sectional concavity 12 thereby supplementing the standard curb between the traffic lane and raised adjoining pedestrian walkway. As stated earlier, an optimal height, h, for pedestrian safety barrier 10 has been found to be about 14" based upon a conventional curb height of about 6". An optimal width has been found to be w, about 14" as well. Of course, the height and width may vary as necessary with regard to the type of traffic to be protected against and the actual curb height. The face of pedestrian safety barrier 10 facing the pedestrian walkway preferably stands at about a 90° angle to the plane of the walkway surface. Pedestrian safety barrier 10 are preferably fixedly secured to said curb or apron by bolts 53, dowels, or similar means. An exemplary technique for securing the barrier employs 1" diameter bolts inserted through drilled holes at about 12 feet o.c.

The shape of cross-sectional concavity 12 should be adapted to match that of the curb which the safety barrier segment is expected to engage. A few standard precast curb types exist. One of the most common is an S-shaped curb 11 with an apron 15 which is shown in FIG. 1. Concavity 12 is configured such that the bottom surface of the concrete member abuts the top and roadside surface of the curb and extends downward approaching the surface of the roadway. In this instance, the bottom of the curb extends outward to meet the roadway proper; and the surface of the extension effectively becomes apportion of the roadway surface.

Many variations and modifications may be made to the pedestrian safety barrier described herein without departing from the relevant principles of the invention. Accordingly, it should be readily understood by persons skilled in the art that the scope of this invention is not limited to the specific applications provided in this disclosure but is intended to encompass any embodiment that falls within the scope and spirit of the appended claims.

I claim:

1. A pedestrian safety barrier for use between a roadway and an adjoining pedestrian walkway having an elongated concrete structure up to about 24 inches in height and provided with a cross-sectional concavity to engage a raised curb.

2. The pedestrian safety barrier of claim 1 having a sidewall which angles outwardly from the barrier base at an angle of between about 60 and about 89 degrees from the transverse axis of the barrier base.

3. The pedestrian safety barrier of claim 1 having a sidewall which angles outwardly from the barrier base at an angle of between about 80 and about 88 degrees from the transverse axis of the barrier base.

4. The pedestrian safety barrier of claim 1 having a sidewall which angles outwardly at an angle of between about 87 and about 88 degrees from the transverse axis of the barrier base.

5. The pedestrian safety barrier of claim 1, wherein the structure is between about 10 and about 24 inches in height.

6. The pedestrian safety barrier of claim 1, wherein the structure is about 14 inches in height.

7. A method of providing a pedestrian safety barrier along a raised curb between a traffic lane and raised adjoining pedestrian walkway by longitudinally disposing a pedestrian safety barrier along a raised curb, said barrier having an elongated concrete structure up to about 24 inches in height and a sidewall facing the roadway which angles outwardly from the barrier base provided with a cross-sectional concavity to engage said raised curb.

8. The method of claim 7 wherein said pedestrian safety barrier is fixedly secured to said raised curb.

9. A pedestrian safety barrier segment for a roadside curb whose roadside face slopes upward and toward the roadway, comprising:

a. a concrete structure configured on its bottom surface to be installed on the top and roadside surface of the curb and to extend downward approaching the surface of the roadway; and b. said concrete structure further configured to present, when installed on the top and roadside surface of the curb, a sidewall surface facing the roadway and sloping down and away from the roadway at an angle of between about 60 and 89 degrees relative to the vertical.

10. The pedestrian safety barrier of claim 9 which is of a height, when installed on the top and roadside surface of the curb, to extend at least about 12 inches above the roadway.

11. The pedestrian safety barrier of claim 10 which is of a height to extend at least about 14 inches above the roadway.

* * * * *